United States Patent [19]

Slattery

[11] Patent Number: 4,860,674

[45] Date of Patent: Aug. 29, 1989

[54] TUFTING MACHINE AND METHOD FOR PRODUCING LEVEL CUT AND LOOP PILE

[75] Inventor: Ian Slattery, Hixson, Tenn.

[73] Assignee: Spencer Wright Industries, Inc., Chattanooga, Tenn.

[21] Appl. No.: 306,643

[22] Filed: Feb. 3, 1989

[51] Int. Cl.[4] ..... D05C 15/20

[52] U.S. Cl. ..... 112/80.42; 112/80.5; 112/80.54; 112/80.55

[58] Field of Search ..... 112/80.55, 80.4, 80.42, 112/80.43, 80.51, 80.56, 80.5

[56] References Cited

U.S. PATENT DOCUMENTS

| | | | |
|---|---|---|---|
| 2,842,080 | 7/1958 | Hoeselbarth | 112/80.55 |
| 2,879,729 | 3/1959 | McCutchen | 112/80.56 X |
| 4,134,347 | 1/1979 | Jolley et al. | 112/80.51 |
| 4,185,569 | 1/1980 | Inman | 112/80.51 |
| 4,790,252 | 12/1988 | Bardsley | 112/80.4 |

*Primary Examiner*—Ronald Feldbaum
*Attorney, Agent, or Firm*—Alan Ruderman

[57] ABSTRACT

A tufting machine for forming loop pile and cut pile selectively in the same row of stitching has a controllably actuated latch carried by a reciprocating bar member for selectively coupling to and driving a needle carrier to a first position into cooperation with a loop seizing member beneath the backing material. The bar member and needle carrier have cooperating abutment members which engage when the latch is not actuated, and the abutment members act to drive the needle carrier not as far downwardly as when the latch is actuated, so that the needle is not driven downwardly as far as the first level and cooperates with the loop seizing member at the higher level. When the needle is driven to the lower level a loop of yarn from the needle is seized and retained by the loop seizing member and is subsequently cut, while at the higher level the loop is seized and then shed to form loop pile. The loop seizing edge of the bill of the loop seizing member is substantially at or slightly below the level of the loop retaining and cutting edge of the blade of the hook, and a downwardly extending nib between the blade and the bill precludes the shed loop from entering the blade of the hook.

21 Claims, 2 Drawing Sheets

TUFTING MACHINE AND METHOD FOR PRODUCING LEVEL CUT AND LOOP PILE

BACKGROUND OF THE INVENTION

This invention relates to tufting machines and more particularly to a method and apparatus for selectively forming cut pile and loop pile having substantially the same pile height as the cut pile in the same row of stitching in a backing material.

In R. T. Card, U.S. Pat. No. 3,084,645, a method and apparatus for tufting cut pile and loop pile in the same row of stitching is disclosed. In spite of the enormous commercial success of that method and apparatus, and of the tufted product produced thereby, it has an inherent shortcoming that has limited it from even further success and acceptance of the tufted product produced. Because uncut loop pile is formed by backrobbing yarn from that loop to move a spring clip away from the point of the hook to allow the loop to be withdrawn from the hook while cut pile is not formed by backrobbing, it produces a tufted product having cut pile ends that project from the backing fabric more than the uncut loop pile. The backrobbing of the yarn is effected by a pattern controlled yarn feed attachment. Thus, the pile height of the fabric produced is not level, but varies with the pattern. The cut pile has a greater pile height than the shorter uncut pile which appears less dense. This effect distracts from the appearance of the tufted product and has limited its appeal.

As pointed out in the aforesaid U.S. Pat. No. 3,084,645 there have been other, but commercially unsatisfactory, approaches for patterning a fabric selectively with cut pile and loop pile. In McCutchen U.S. Pat. No. 2,879,728 selective loops on the hook are pushed off by a pattern controlled finger while others are allowed to stay on and are cut. Another proposal is illustrated in McCutchen U.S. Pat. No. 2,879,729 wherein each needle has two opposed hooks associated therewith, one with a knife. When cut pile is desired a loop is transferred from the hook without the knife to the one with the knife. Although these proposals illustrate even level cut and loop pile their shortcomings are readily apparent; simplicity and reliability being primary concerns of the tufted fabric industry.

An effective approach to obtaining even level cut and loop pile is disclosed in U.S. Pat. No. 4,134,347 of Jolley et al, assigned to the common assignee of the present invention, in which a pivotable gate member engagably cooperates with the bill of the hook to selectively open or close the passage from the bill to the hook blade of a seized loop. The loop is seized by the bill and the gate either allows or prevents a loop from moving beyond the bill to the closed end of the hook. Those loops that are allowed passage are cut, the other loops are shed by the bill. Setting of the stitches in the fabric draws both the cut and uncut loops to substantially the same level. A similar but different approach is disclosed in U.S. Pat. No. 4,185,569 of Inman, also assigned to the same assignee of the present invention. In these machines, a yarn feed pattern attachment for selectively controlling the yarn is not required.

Although the apparatus disclosed in the aforesaid Jolley et al, and Inman patents may provide satisfactory results, they have some shortcomings. Firstly, since each gate is individually controlled by pneumatic means or the like, a limitation on he minimum gauge or spacing between laterally adjacent hooks results. Thus, the gauge or spacing between adjacent tufts is larger or coarser than that which may be desirable for some commercially aesthetic carpet designs. Secondly, since the gate and control cylinders or the like are disposed beneath the bed of the tufting machine, the lint which results from the cutting of the yarn and the movement of the yarn on the hooks, tends to hinder the pivotal movement of the gate and additionally may effect the operation of the pneumatic cylinders. Thus, these "level-cut-loop" machines have been limited somewhat in their application.

In other known tufting machines, those machines known in the art as controlled needle tufting machines, the various needles may be selectively engaged and dispensed, in skip-stitch fashion in accordance with a program during each recipricatory cycle of the needle driving push rods. Basically, these machines render selective needles or groups of needles inoperative while the remainder of the needles are operative to pierce and penetrate the backing fabric upon each downward stroke of the push rods. Examples of these machines are illustrated in U.S. Pat. Nos. 3,115,856; 3,259,088; 3,881,432; 3,986,465 and 4,794,874. Such machines have been very successful, especially for producing bedspreads, and in the case of individually controlled needle tufting machines have been widely accepted for overtufting a design into a pretufted fabric, as illustrated in U.S. Pat. No. 4,693,190.

In these controlled needle tufting machines, each needle cooperates with its own respective loop seizing hook, and each hook cooperates with one needle. However, in Price copending U.S. application Ser. No. 07/179,073 filed on Apr. 8, 1988, (Notice of Allowance mailed 10/19/88), assigned to the same assignee as the present invention, a tufting machine having a pair of rows of spaced apart needles independently selectively driven into cooperation with hooks is disclosed, the machine in one form being capable of producing tufted fabric having half the gauge of conventional controlled needle machines by staggering the needles in one row relative to the needles in the other row and providing a loop seizing hook for cooperation with each needle.

Except for the loop pile fabric produced by the method disclosed in the aforesaid U.S. Pat. No. 4,794,874, all of the aforesaid controlled needle machines produce cut pile fabric. The prior art has not developed, nor is it believed that the prior art has even proposed, a tufting machine having individually controlled needles which can produce cut and/or loop pile selectively in the same row of stitching. Such a machine, since it does not utilize a yarn feed pattern attachment, would be capable of producing cut pile and loop pile having the same pile height as the cut pile, and would not have the disadvantages associated with machines having gated hooks.

SUMMARY OF THE INVENTION

Consequently, it is a primary object of the present invention to provide a tufting machine and a method of tufting wherein each needle may be activated to selectively cooperate with a loop seizing member to produce either loop pile or cut pile.

It is another object of the present invention to provide a tufting machine and method of tufting wherein each needle of the machine may be reciprocably driven through a base material to at least two different distal positions selectively relative to the base material, the needle cooperating with a loop seizing member at one position for forming loop pile and at the other position for forming cut pile.

It is a further object of the present invention to provide a tufting machine and method of tufting wherein each needle of an array of yarn carrying needles may be activated to cooperate with a respective loop seizing member to produce tufted fabrics having a patterned arrangement of cut pile and loop pile of substantially the same pile height.

It is a still further object of the present invention to provide a method and apparatus for selectively coupling a reciprocating member to a needle carrying member at one of at least two locations selectively for driving the needle to two distinct distal positions beneath a base material pierced by the needle, the needle cooperating with a loop seizing member at one of said positions to form loop pile and at the other of said positions to form cut pile.

It is a still further object of the present invention to provide a method and apparatus for tufting loop pile and cut pile selectively in the same row of stitching, the method and apparatus comprising the driving of the yarn carrying needle to at least two different locations selectively for cooperating with a loop seizing member, the loop seizing member seizing and shedding the loop when the needle is driven to a first of the positions while the loop seizing member seizes and retains the loop when the needle is driven to a second position, the shed loop forming loop pile and the retained loop subsequently being cut by a knife forming cut pile.

In accordance with the present invention a controlled needle machine is utilized to form loop pile and cut pile selectively in the same row of stitching, the machine having a controllably actuated latch carried by a reciprocating bar member for selectively coupling to and driving a needle holder or carrier to drive the needle to a first level beneath a backing material into cooperation with the loop seizing member, the bar member and needle carrier having cooperating abutment members which engage when the latch is not coupled to the needle carrier. The engagement of the abutment members are at a lower level than the level at which the latch couples to the needle carrier so that when the latch is not coupled, the needle is not driven downwardly as far as when the latch coupling occurs, but is driven to a second and higher level beneath the backing material into cooperation with the loop seizing member. At the first or lower level the loop is seized and retained by the loop seizing member and is subsequently cut, while at the second or higher level the loop is seized and is then shed or released to form loop pile. The loop seizing edge of the bill of the loop seizing hook is substantially at or slightly below the level of the loop retaining and cutting edge of the blade of the hook, and a downwardly extending nib intermediate the blade and the bill precludes those loops which are shed to form loop pile from entering the blade of the hook.

In a conventional controlled needle tufting machine each needle carrier may be selectively latched or coupled to the latch carrying needle drive bar, and when so latched the needles or needle in an individually controlled needle machine is driven into cooperation with the loop seizing hook to form cut pile. When the needle carrier is not so coupled to the drive bar, the needles or needle carried by that carrier is not driven and skips that stitch. Any number of stitches may be skipped by the needle until the carrier is again latched or coupled to the needle drive bar. The coupling and uncoupling of the needle carrier is controlled by a pattern. Since a controlled needle tufting machine has a multiplicity of needle carriers, the fabric produced thereby has cut pile tufts disposed at selective locations across the fabric according to the pattern. Thus, at any location across the fabric, there is either a cut pile tuft or no tuft formed by the machine.

In accordance with the method and machine of the present invention each needle holder may be latched and thereby coupled to the needle drive bar in conventional manner to cooperate with the loop seizing hook to form a cut pile tuft. However, when the needle holder is not latched or coupled to the drive bar, a first abutment means disposed on the drive bar below the latch engages a cooperating second abutment means carried by the needle carrier below the location of the first abutment means when the latch is coupled to the needle holder, so that the drive bar drives the needle holder downwardly a shorter distance than when the needle holder is conventionally coupled to the drive bar to cooperate with the loop seizing member to form a loop pile tuft. The loop seizing member cooperates with the conventionally coupled needle by seizing and retaining the loop of yarn for subsequent cutting by a knife, but merely seizes and sheds each loop of yarn when the needle holder is driven by engagement of the cooperating abutment means and the loop seizing member is precluded from retaining the loop presented at this higher level.

In the preferred form of the invention, the loop seizing hook member has a depending nib to the rear and beneath the tip of the bill so as to preclude the loop presented at the higher level from entering the blade portion of the hook and thus ensures that the loop is shed. When the loop is presented at the lower level, the loop is below the nib and may enter the blade of the hook. The level of the lower edge of the loop seizing portion of the bill is substantially the same or below the level of the lower edge of the blade so that as a seized and retained loop is pulled to and engages the lower edge of the blade, it is at substantially the same level as the shed loop. Thus, when the retained loop is cut, the cut pile tufts are at substantially the same level as the loop pile tufts.

In the preferred embodiment of the invention the needle drive bar carries a pneumatically actuated latch pin for selectively coupling to a respective needle holder for forming cut pile, the latch pin being connected to a pneumatic cylinder controlled by valve means which is in turn controlled by a pattern control system. When the latch pin is actuated, the needle holder is coupled to the drive bar on its down stroke, and when the latch pin is deactivated the abutment members engage on the down stroke of the bar to drive the needle holder downwardly. Since the latch carrying drive bar moves downwardly relative to the needle holder unless coupled thereto by the latch pin, when the latch pin is not actuated, the disposition of the abutment members results in the needle holder being driven downwardly a smaller amount through the cooperation of the abutment members than when the latch pin is engaged. This shorter distance that the needle holder is driven results in the needle carried thereby to be driven to a bottom dead center position that is at a higher level than when the latch pin is actuated. At the higher level yarn carried by the needle is seized by the bill of the loop seizing member, while at the lower level the yarn carried by the needle passes about the nib of the loop seizing member and is drawn to the edge of the blade thereof.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
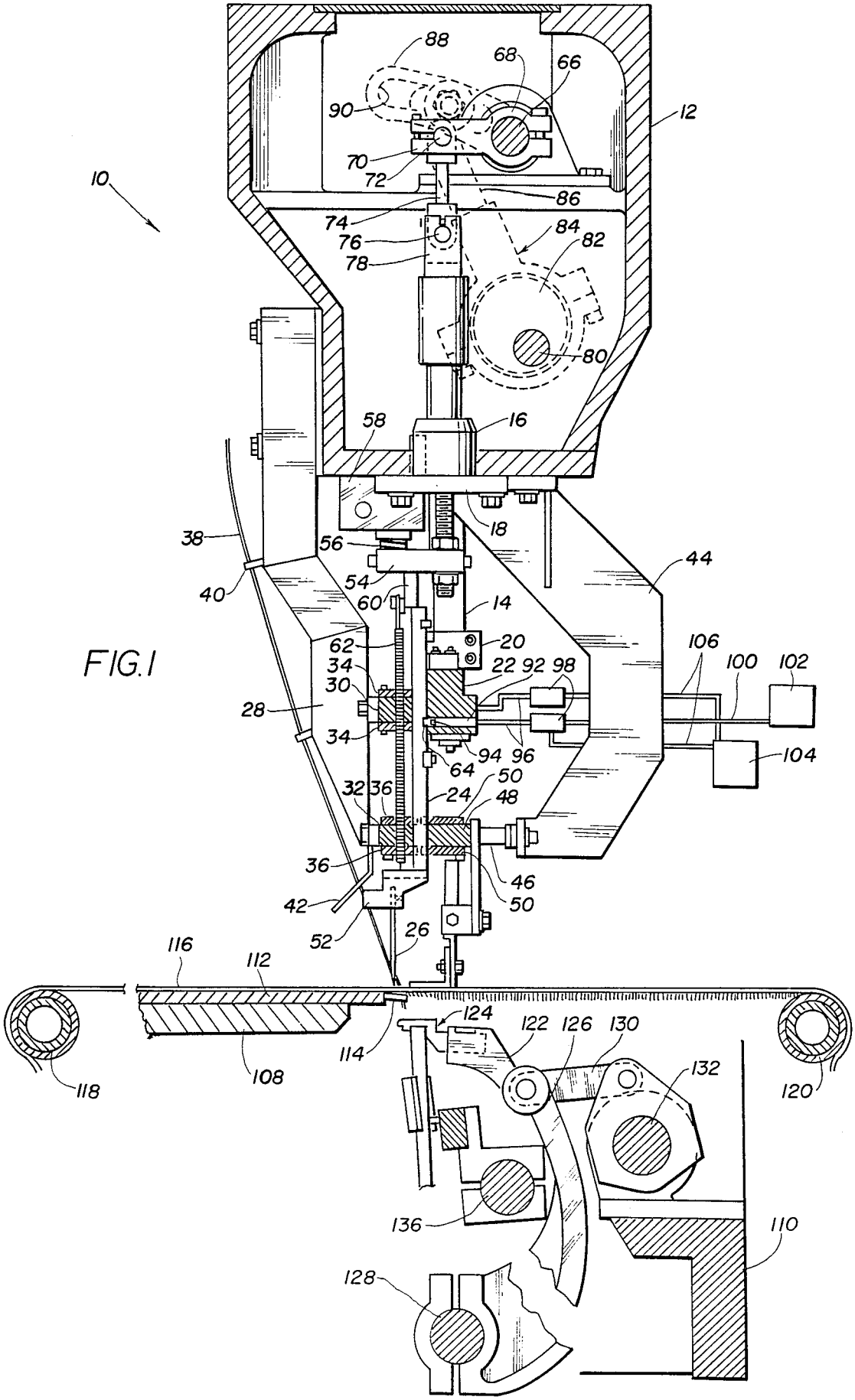
FIG. 1 is a fragmentary vertical cross sectional view taken substantially through a tufting machine constructed in accordance with the principles of the present invention.
Figure 2:
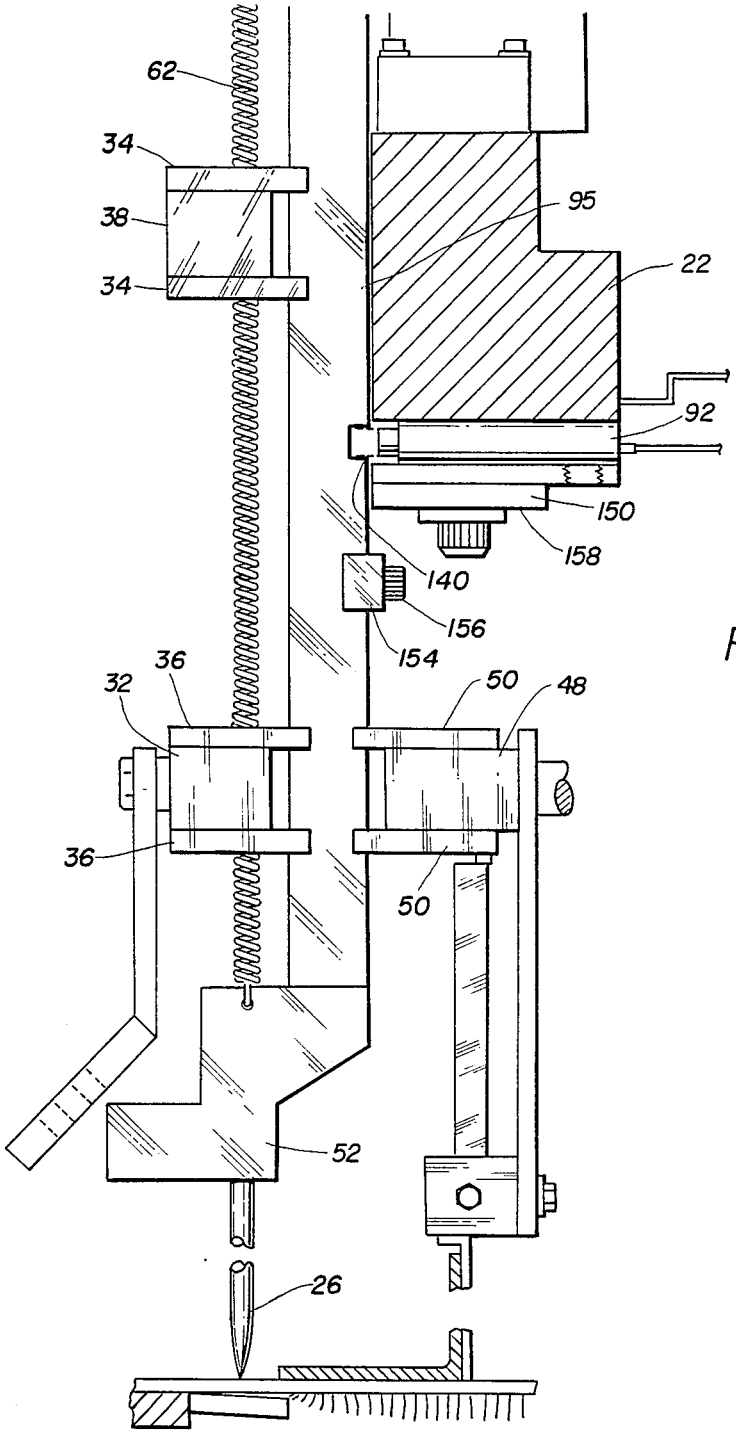
FIG. 2 is an enlarged fragmentary view of a portion of the tufting machine illustrated in FIG. 1.

Referring to the drawings, and more particularly to FIG. 1, a tufting machine 10 embodying the preferred mode of carrying out the present invention is disclosed. The machine comprises a head 12 within which is mounted conventional drive mechanism for reciprocably driving a plurality of push rods 14, only one of which is shown, journalled for reciprocation within respective collars 16 supported in a support plate 18 at the bottom of the head. At the lower end of each push rod 14 is a push rod foot 20 having secured to the bottom end thereof is a needle drive bar 22 extending transversely across the tufting machine and supported by each of the push rod feet. Slidably supported for selective coupling to the needle drive bar are a plurality of needle carriers 24, each of which preferably supports a single needle 26.

Attached to the head 12 of the machine is a plurality of guide bar support brackets 28 which carries a pair of vertically spaced guide bars 30, 32, each of which is sandwiched between a pair of guide plates 34, 36. Yarn 38 may be fed to the needles in any conventional manner, such as by feed rollers or the like (not illustrated) through yarn guide members 40 carried by the support brackets 28 and a yarn guide 42 fastened between the brackets 28 and the lower guide bars 32 and which may function as a yarn jerker. At the rear of the machine a support bracket 44 is carried by the head 12 of the machine and at its lower end carries a spacer member 46 which is secured to a rear guide bar 48 sandwiched between a pair of guide plates 50. The needle carriers or holders 24 are mounted between the guide plates 34, 36 and 50 and are guided thereby. A needle mounting bar 52 is carried at the bottom of each needle holder or carrier 24, each needle mounting bar 52 carrying a respective one of the needles 24. An adjustable stop bar 54 is supported by a lead screw 56 carried by a jack screw device 58 in a manner similar to and for the purposes as described in the aforesaid U.S. Pat. No. 3,881,432. Extending downwardly from the stop bar 54 is an abutment member 60 to which the upper end of a multiplicity of springs 62 are attached, there being one spring for each needle carrier 24, and the lower end of each spring is connected to a respective needle mounting bar 52. The springs 62 act to normally urge the needle carriers 24 upwardly against the bottom of the abutment member 60.

The push rods 14 together with the needle drive bar 22 reciprocate vertically during each cycle of the machine. Extending through the needle drive bar 22 substantially normal to the reciprocation path are a multiplicity of bores. 64 which are preferably staggered transversely so that one bore corresponds to each needle in the machine for an individually controlled needle tufting machine. The push rods 14 may be driven by adjustable drive means similar to that disclosed in U.S. Pat. No. 2,977,905, the drive generally comprising a mainshaft 66 rotatably mounted in the head 12 of the machine. Each push rod 14 includes a rocker arm 68 clamped to the mainshaft 66 and extending radially therefrom to provide a crank arm 70 conventionally connected by a wrist pin 72 to a connecting link 74. Another wrist pin 76 may connect the lower end of the link 74 to an enlarged split upper end 78 of the push rod 14. The rocking motion of the shaft 66 thus effects a reciprocating motion of the push rods and hence the needle drive bar 24.

Rocking motion may be conventionally supplied to the mainshaft 66 through means including a camshaft 80 mounted parallel to the mainshaft 66 and driven at one end of the machine by conventional means. A circular eccentric cam 82 is secured on the shaft 80 preferably adjacent each end and a connecting rod 84 is journally mounted on the cam. The upper end 86 of the connecting rod is adjustably connected to a drive lever 88 secured at one end to the mainshaft 66, the drive lever 88 having an arcuate slot 90 within which the upper end 86 of the connecting rod is connected. The path of the slot 90 has a center of curvature coinciding with the geometric center of the cam 82 when the cam is at bottom dead center so that the needle stroke may be adjusted without changing the bottom position thereof. Repositioning of the connection between the upper end 86 of the connecting rod 84 in the slot 90 changes the amplitude of oscillation of the lever 88 and effects a change in amplitude in rocking of the shaft 66.

As aforesaid the needle drive bar 22 includes a multiplicity of bores 64, the bores extending in the front to rear direction relative to the machine. Mounted within each bore 64 is a respective air cylinder 92 having a respective latch pin 94. Each needle carrier 24 includes a vertically extending stepped recess 95 for receiving the latch pin 94 when extended, and when a selected needle is to be coupled to the drive bar 22 the pin 94 enters the recess 95 and drives the needle carrier downwardly to form cut pile. Each air cylinder 92 communicates through a conduit 96 to a respective electrically controlled pneumatic valve 98 which further communicates through conduits 100 with a single source of pressurized air such as a compressor 102. The valves 98 are electrically controlled by a pattern control 104 through electrical leads or the like 106, the pattern control 104 preferably being a computer driven control system loaded with pattern information from, for example, a floppy disk or the like prepared on a separate pattern generation system. Consequently, as determined by the pattern control 104 each valve 98 individually and selectively may permit air to flow from the compressor to the respective cylinder 92 to extend the latch pin 94, or vent the valve. The pin 94 is biased to the retracted positions so that when pressurized air is not supplied to the cylinder 92, the pin is not extended.

Mounted on a bed plate 108 in the bed 110 of the machine beneath the head 12 is a needle plate 112 which carries needle plate fingers 114, the needle plate 112 and fingers 114 supporting a backing material 116 fed from feed rollers 118 over the bed and wound onto take-off rollers 120, only one roll being illustrated in regard to the feed rollers and the take-off rollers. Mounted in the bed and driven in an oscillatory manner in timed relationship with the push rods 14 is a loop support bar or the like 122 to which is secured the mounting portion 123 of a multiplicity of respective loopers or hooks generally indicated at 124, there being one such looper or hook for each needle 26 for seizing loops of yarn therefrom as hereinafter described. The loopers are conventionally mounted on the upper end of a rocker arm 126 oscillated about a rock shaft 128 by means of a link 130 connected to the arm 126 and an oscillating jack shaft driven in timed relationship with the crankshaft 80. The loops which are seized and held by the loop seizing looper or hooks may be cut by respective knives 134 coacting with the hooks to form cut pile, the knives 134 being oscillated relative to the loopers by means of a drive shaft 136 in conventional manner. These loopers or hooks are modified cut pile hooks, each comprising a body member having a loop entering and seizing bill 138 which points in the direction opposite to which the backing material 116 is fed through the machine, the bill being at the free end of the hook.

Figure 3:
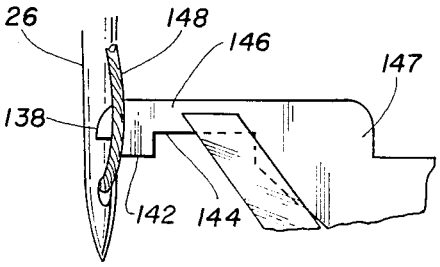
FIG. 3 is a diagrammatic view illustrating the relationship of the stitch forming instrumentalities of the tufting machine when seizing loops for forming cut pile in accordance with the present invention.
Figure 4:
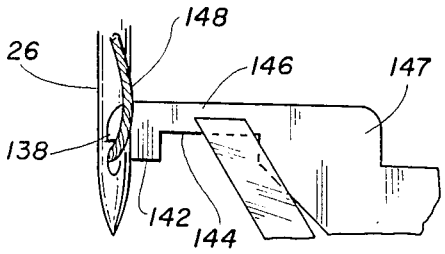
FIG. 4 is a view similar to FIG. 3 but illustrating the relationship of the stitch forming instrumentalities of the tufting machine when seizing loops for forming loop pile in accordance with the present invention.

In a tufting machine as thus far described, each needle 26 may be selectively driven by coupling the corresponding needle carrier 24 to the needle drive bar 22, the coupling being by actuation of the latch pin 94 which acts against the shoulder 140 at the lower end of the recess 95 in the needle carrier 24 to drive the needle carrier downwardly with the drive bar. A needle thus coupled to the bar 22 is driven downwardly to pierce and penetrate the backing material 116 and into cooperative engagement with the looper or hook 124. The hook preferably has a nib 142 depending downwardly slightly to the rear and beneath the bill 138, the nib being between the bill 138 and the lower edge 144 of the blade 146 of the hook, the blade extending from the shank 147 at the closed end of the hook adjacent the mounting portion 123. As the needle begins to ascend from the bottom dead center position, a loop of yarn 148 is thrown out and the bill 138 of the hook together with the nib 142 enters and seizes that loop as illustrated in FIG. 3. The loop is drawn to the edge 144 as the needle continues its upward movement, and is precluded from escaping from the hook because of the direction of the backing material feed and additionally because of the nib 144. Thus, a loop so seized is retained on the blade 146 of the hook until cut by the knife 134 acting in conventional manner.

In conventional controlled needle machines, when the needle carrier for a particular needle is not coupled to the drive bar as aforesaid, the needle is not driven but skips without making a stitch. Thus, the needle only produces cut pile fabric with the tufts inserted at selective locations. In accordance with the preferred form of the present invention, however, a buffer plate or shim defining a first abutment member 150 is fastened by attaching means such as a bolt or the like 152 to the lower face of the needle drive bar 22, the abutment member 150 being sized so as not to engage and interfere with the needle carriers 24. Additionally, each needle carrier corresponding to where a loop pile forming stitch may be desired carries another or second abutment member in the form of a block 154 at a location beneath the shoulder 140 of the recess 95, the second abutment 154 projecting from the surface of the needle carrier 24 for engagement by the first abutment member 150 when the latch corresponding to that needle carrier is not extended. Preferably, the second abutment member 154 is adjustably connected to the needle carrier and may be in the form of a narrow saddle or U-shaped block member and may be fastened to the corresponding carrier 24 by a clamp or other conventional connecting means 156 so that its location may be finely adjusted relative to the lower surface 158 of the first abutment member 150 when the latch pin 94 is disposed within the recess 95 adjacent the shoulder 140. The distance between the surface 158 and the top of the abutment member 154 at that time is in the order of approximately $\frac{1}{4}$ of an inch. Thus, when the latch pin 94 is not extended, the first and second abutment members 150 and 154 will engage at approximately $\frac{1}{4}$ inch below the location where the latch pin 94 when extended engages the shoulder 140, and the needle carrier will thus be driven downwardly by the drive bar abutment member 150 to bring the needle 26 to a bottom dead center position approximately $\frac{1}{4}$ of an inch above the bottom dead center position when the latch pin is extended. As the needle begins to ascend from this higher dead center position and the loop of yarn 148 is thrown out, the loop is above the surface of the nib 142 of the looper or hook and only the bill 138 may seize that loop so that the loop will not enter the blade 146 of the looper 124. A loop 148 seized merely by the bill 138 is then shed as the looper conventionally oscillates away from the needle path and as the needle continues to ascend. The level of the loop seizing edge of the bill preferably is slightly below the level of the edge 144 of the blade so that as the needle ascends the loop is pulled to and formed at substantially the same level as the edge 144, and since it is not cut by the knife 134, it forms a loop pile tuft at substantially the same level as the cut pile tufts formed as aforesaid.

Accordingly, in each stitch a cut pile tuft or a loop pile tuft may be produced selectively, the cut pile being produced by actuation or extension of the latch pin 94, or a loop pile may be produced when the pin is not extended. The pattern control 104 controls whether cut pile or loop pile is produced, and since there is no backrobbing the cut pile and loop pile will be at substantially the same level, i.e., extending from the backing material 116 substantially the same amount.

Although in the preferred embodiment of the invention a single actuatable latch and fixed abutment members are utilized to drive each needle carrier to form cut pile and loop pile selectively, it is within the scope of the present invention, and the present invention contemplates, that situation where rather than fixed abutment members another actuatable latch would be carried by the drive bar for each needle carrier. Although in that case the spacing of two latches for each needle carrier could result in a relatively complex and costly machine, it would have the added feature of providing an additional degree of selectively, namely, cut pile could be produced by actuating one of the latches, loop pile produced by actuating the other latch, and no stitching produced if neither latch were actuated.

Numerous other alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a tufting machine having a head for mounting drive means including a drive bar reciprocating in a linear path, a bed disposed beneath the head having means for supporting a base material fed in a longitudinal direction substantially normal to said path, a needle carrier for mounting at least one needle at a bottom distal end thereof, means for mounting said needle carrier for reciprocation parallel to said path, said drive bar carrying a latch member selectively operable between an active position for coupling said needle carrier to said drive bar at a first location for reciprocation therewith for driving said needle to a first bottom dead center position, and an inactive position, said drive bar and said needle carrier having respective abutment means adapted to cooperatively engage at a second location only when said latch member is in said inactive position for driving said needle carrier and said needle to a second bottom dead center position spaced from said first-bottom dead center position, loop seizing means in said bed for seizing and retaining loops of yarn presented by said needle when driven to said first bottom dead center position and for seizing and shedding loops kf yarn presented by said needle when driven to said second bottom dead center position, a knife cooperating with said loop seizing means for severing loops of yarn seized and retained by said loop seizing means, and control means for selectively moving said latch member between said active position and said inactive position.

2. In a tufting machine as recited in claim 1, wherein said first bottom dead center position is below said second bottom dead center position.

3. In a tufting machine as recited in claim 2, wherein said first location is above said second location.

4. In a tufting machine as recited in claim 1, wherein said abutment means of said drive bar comprises a plate, and means for securing said plate to said drive bar at a location spaced beneath said latch member.

5. In a tufting machine as recited in claim 4, wherein said abutment means of said needle carrier comprises a block fastened to said needle carrier at said second location.

6. In a tufting machine as recited in claim 5, wherein said first bottom dead center position is below said second bottom dead center position.

7. In a tufting machine as recited in claim 6, wherein said first location is above said second location.

8. In a tufting machine as recited in claim 1, wherein said loop seizing means comprises a body member having a blade extending from a mounting shank and terminating at a free end defining a bill pointing opposite the direction of feed of the base material, means for mounting said shank for oscillation in timed relationship to said needle, said blade and said bill having respective loop seizing edges, and a nib formed on said blade adjacent said bill and extending from said edges, said bill and said nib entering loops of yarn presented by said needle when said needle is driven to said first bottom dead center position, and only said bill entering loops of yarn presented by said needle when driven to said second bottom dead center position, whereby loops entered by said nib enter onto said blade and are retained thereon.

9. In a tufting machine as recited in claim 8, wherein the loop seizing edge of said blade is disposed closer to said head than the loop seizing edge of said bill.

10. In a tufting machine as recited in claim 8, wherein said abutment means of said drive bar comprises a plate, and means for securing said plate to said drive bar at a location spaced beneath said latch member.

11. In a tufting machine as recited in claim 10, wherein said abutment means of said needle carrier comprises a block fastened to said needle carrier at said second location.

12. In a tufting machine as recited in claim 11, wherein said first bottom dead center position is below said second bottom dead center position.

13. In a tufting machine as recited in claim 12, wherein said first location is above said second location.

14. In a tufting machine having a head for mounting drive means including a push rod reciprocating in a linear path, a bed disposed beneath the head having means for supporting a base material fed in a longitudinal direction substantially normal to said path, a needle carrier for mounting at least one needle at a bottom distal end thereof, means for mounting said needle carrier for reciprocation parallel to said path, needle drive means carried by said push rod for coupling said push rod to said needle carrier at least at two different locations along said path selectively for driving said needle downwardly into said bed to at least two different bottom dead center positions, loop seizing means in said bed for seizing and retaining loops of yarn presented by said needle when driven to one of said bottom dead center positions and for seizing and shedding loops of yarn presented by said needle when driven to a second of said bottom dead center positions, a knife cooperating with said loop seizing means for severing loops of yarn seized and retained, by said loop seizing means, and control means for selecting the coupling location of said needle drive means with said needle carrier.

15. A method of tufting cut pile and loop pile in the same row of stitching comprising supporting and feeding a base material in one direction, actuating a needle to stitch a yarn continuously through said base material as the material moves to form a row of successive yarn loops on one side of said material, supporting at said one side of said material an oscillating hook having a blade terminating in a free end pointing in the direction opposite the material feed so that at least the free end enters the loops in succession, said hook having a nib adjacent the free end disposed further from the base material than said free end and said blade, said actuating of the needle comprising selectively driving said needle to form selected loops below the level of said nib so that said free end and said nib enter said selected loops, driving said needle to form other loops above the level of said nib, shedding said other loop from the free end to produce uncut loop, and severing said selected loops upon said blade to produce cut pile.

16. A method of tufting cut pile and loop pile as recited in claim 15, wherein said driving of said needle to form selected loops comprises reciprocating a drive member along a fixed path, coupling said needle to said reciprocating drive member at a first location along said path, and said driving of said needle to form said other loops comprises coupling said needle to said reciprocating drive member at a second location along said path.

17. A method of tufting cut pile and loop pile in the same row of stitching comprising supporting and feeding a base material in one direction, stitching a yarn through said base material to two different locations relative to said base material as said material moves to form successive yarn loops in a row on one side of said material, seizing said loops by an oscillating hook having a free end pointing in the direction opposite the material feed so that the free end enters all the loops in succession, shedding loops stitched to a first of said locations from the free end of said hook, retaining loops stitched to the other of said locations on said hook, and severing the retained loops.

18. A method of tufting cut pile and loop pile as recited in claim 17, wherein said stitching of yarn to two different locations comprises coupling a yarn carrying needle to a reciprocating ember at two different dispositions along the reciprocating path.

19. A method of tufting cut pile and loop pile as recited in claim 18, wherein said hook has a nib adjacent said free end disposed further from said base material than said free end, and said stitching of yarn to said first location comprises forming loops closer to said base material than said nib but further from said base material than said free end.

20. A method of tufting cut pile and loop pile as recited in claim 19, wherein said stitching of yarn to said other of said locations comprises forming loops further from said base material than said nib.

21. A hook for use in a tufting machine, said hook comprising a body portion including a blade and a shank having a mounting portion for mounting in a tufting machine hook bar, said blade extending from said shank to a free end defining a bill remote from said shank, said blade having a top edge extending to said bill and a bottom edge that extends from said shank, said bill having a top edge forming a continuation of said top edge of said blade and a bottom edge spaced at or below said bottom edge of said blade, and means defining a nib extending from said bottom edge of said blade adjacent said bill to below said bottom edge of said bill.

* * * * *